US011896048B2

(12) United States Patent
Batista et al.

(10) Patent No.: US 11,896,048 B2
(45) Date of Patent: Feb. 13, 2024

(54) AEROSOL GENERATING ARTICLES

(71) Applicant: PHILIP MORRIS PRODUCTS S.A., Neuchatel (CH)

(72) Inventors: Rui Nuno Batista, Morges (CH); Eva Ferrari, Bologna (IT); Yves Jordil, Lausanne (CH); Poh Yoke Tritz, Yverdon-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 269 days.

(21) Appl. No.: 16/976,888

(22) PCT Filed: Feb. 25, 2019

(86) PCT No.: PCT/EP2019/054544
§ 371 (c)(1),
(2) Date: Aug. 31, 2020

(87) PCT Pub. No.: WO2019/170454
PCT Pub. Date: Sep. 12, 2019

(65) Prior Publication Data

US 2021/0037881 A1 Feb. 11, 2021

(30) Foreign Application Priority Data

Mar. 8, 2018 (EP) ..... 18160816

(51) Int. Cl.
*A24D 3/02* (2006.01)
*A24D 3/06* (2006.01)
(Continued)

(52) U.S. Cl.
CPC ..... *A24D 3/0229* (2013.01); *A24D 3/0266* (2013.01); *A24D 3/04* (2013.01);
(Continued)

(58) Field of Classification Search
CPC ..... A24D 3/0229; A24D 3/17; A24D 3/0266; A24D 3/04; A24D 3/065; A24D 3/0254;
(Continued)

(56) References Cited

U.S. PATENT DOCUMENTS 3,774,508 A * 11/1973 Berger ..... A24D 3/0283 493/47
4,149,550 A 4/1979 Green
(Continued)

FOREIGN PATENT DOCUMENTS

EP 0 047 621 3/1982
EP 2822409 B1 * 4/2016 ..... A24D 3/0204
(Continued)

OTHER PUBLICATIONS

PCT Search Report and Written Opinion for PCT/EP2019/054544 dated Apr. 16, 2019 (8 pages).
(Continued)

*Primary Examiner* — Jacob A Smith
(74) *Attorney, Agent, or Firm* — Mueting Raasch Group

(57) ABSTRACT

A filter part (1) for use in an aerosol generating article and a method of manufacturing the filter part (1). The filter part (1) includes an aerosol permeable core (11) surrounded by a sleeve (12). The sleeve (12) is formed of linear, axially oriented fibres and the core (11) is formed of expanded, randomly oriented fibres. The method includes forming two or more strips (2*a*, 2*b*) into segments surrounding a conveying path, bringing the segments together into a sleeve former (7) to form the sleeve (12) and introducing loose fibres (52) between the segments upstream of the sleeve former (7) such that they are drawn therein in a random orientation and compressed between the segments as they are brought together to form a filter rod (8) with an aerosol
(Continued)

permeable core (11) within the sleeve (12). The filter rod (8) is then cut to form the filter part (1).

18 Claims, 4 Drawing Sheets

(51) Int. Cl.
*A24D 3/04* (2006.01)
*A24D 3/17* (2020.01)

(52) U.S. Cl.
CPC ..... *A24D 3/065* (2013.01); *A24D 3/17* (2020.01); *A24D 3/0254* (2013.01)

(58) Field of Classification Search
CPC ... A24D 3/0204; A24D 3/0233; A24D 3/0237
USPC ..... 493/39, 45, 44, 42, 50
See application file for complete search history.

(56) References Cited

U.S. PATENT DOCUMENTS

| | | | | |
|---|---|---|---|---|
| 4,593,706 | A | 6/1986 | Preston | |
| 5,107,863 | A | 4/1992 | Nyffeler | |
| 8,534,294 | B2 * | 9/2013 | Yang | A24D 3/02 493/47 |
| 9,867,394 | B2 | 1/2018 | Giannini | |
| 2003/0140932 | A1 | 7/2003 | Seidel | |
| 2010/0006112 | A1 | 1/2010 | Yang | |
| 2011/0023900 | A1 | 2/2011 | Clarke | |

FOREIGN PATENT DOCUMENTS

| | | | | |
|---|---|---|---|---|
| GB | 2113068 A * | 8/1983 | | A24D 3/0237 |
| GB | 2143867 A * | 2/1985 | | A24D 3/08 |
| JP | 2003-525043 | 8/2003 | | |
| JP | 2011-505851 | 3/2011 | | |
| JP | 2015-509374 | 9/2013 | | |

OTHER PUBLICATIONS

Extended European Search Report for Application No. 18160816 dated Sep. 13, 2018 (7 pages).
Office Action dated in Japan for Application No. 2020-541350 dated Mar. 20, 2023 (10 pages). English translation included.

* cited by examiner

AEROSOL GENERATING ARTICLES

This application is a U.S. National Stage Application of International Application No. PCT/EP2019/054544 filed Feb. 25, 2019, which was published in English on Sep. 12, 2019 as International Publication No. WO 2019/170454 A1. International Application No. PCT/EP2019/054544 claims priority to European Application No. 18160816.7 filed Mar. 8, 2018.

This invention relates generally to aerosol generating articles. More specifically, although not exclusively, this invention relates aerosol permeation elements used in tubular shaped aerosol generating articles including, in particular, such aerosol generating articles configured to heat aerosol forming substrates without burning them. This invention also relates to methods of manufacturing such articles and elements.

The filter part of an aerosol generating article performs several functions and, as such, several of its properties must be considered in its design and manufacture. The main role of the filter part is filtration efficiency, namely its effectiveness in removing unwanted components of the aerosol, but this must always be balanced with the overall resistance to draw, which is the pressure drop experienced as the aerosol passes through the filter. An additional complication with aerosol generating articles configured to heat aerosol forming substrates without burning them is that the quantity of sensory media tends to be more closely packed. As such, the inherent resistance to draw provided by the sensory media in such aerosol generating articles is generally much higher than that of traditional smoking articles.

There are several other requirements of the filter part which result from its interaction with the mouth of a consumer. These include, for example, structural rigidity and resistance to wetting. The filter part of an aerosol generating article can often experience significant compressive forces exerted thereon by the consumer. Some consumers also enjoy chewing the filter part and often have expectations as to its resistance to compressibility. The structure of the filter part must be able to withstand such forces, whilst both continuing to perform its main function and satisfying consumer expectations. The filter part must also continue to function despite exposure to the saliva of a consumer and should minimise or prevent its transmission therethrough to avoid wetting of the aerosol forming substrate.

These competing requirements, namely effective filtering, minimal resistance to draw, compressibility and resistance to wetting, must all be balanced in the final product. It would therefore be advantageous to provide an aerosol permeation element which provides a balance between these competing factors.

One known method of manufacturing filter parts of smoking articles involves pulling a continuous rod of filter material, for instance cellulose acetate, on a moving band of wrapping paper, which is closed and glued around the rod. The continuous wrapped rod is then cut into lengths or sticks, which are then joined to the rest of the smoking article by a tipping paper, providing the requisite resistance to wetting. The wrapping paper is generally hard for resisting the consumer's mouth pressure, which makes it difficult to shape. Moreover, it can impact the taste of the aerosol and the gluing process can present challenges.

Another known method of manufacturing filter parts of smoking articles involves the use of a laminated poly lactic acid (PLA) sheet in place of the hard wrapping paper. PLA sheets are more straightforward to shape, resist saliva and air transmission and are biodegradable. However, such sheets still share some of the same disadvantages as wrapping paper.

It would therefore be advantageous to provide an alternative method of manufacturing an aerosol permeation element, preferably one which at least mitigates one or more issues associated with known smoking articles.

U.S. Pat. No. 4,149,550A discloses a fibrous element comprising an elongated structure having a fibrous core with the fibres arranged in random orientation.

Accordingly, a first aspect of the invention provides an aerosol permeation element for use in an aerosol generating article, the aerosol permeation element comprising an aerosol permeable core surrounded by a sleeve, wherein the sleeve comprises linear, axially oriented fibres and the core comprises expanded multidirectional or randomly (or both multidirectional and randomly) oriented fibres.

According to the present invention there is provided an aerosol permeation element for use in an aerosol generating article, the aerosol permeation element comprising an aerosol permeable core surrounded by a sleeve, wherein the sleeve comprises linear, axially oriented fibres and the core comprises expanded, randomly oriented fibres, wherein the sleeve comprises two or more longitudinal segments formed from the same tow and the tow material of the longitudinal segments is bonded together at least along longitudinal edges of the segments to form an integral sleeve.

The provision of a sleeve with linear, axially oriented fibres and a core with expanded multidirectional or randomly or both multidirectional and randomly oriented fibres has been found to provide an advantageous, novel balance between the aforementioned properties.

As used herein, linear and axially oriented fibres refers to a plurality of fibres that are substantially aligned with one another along an axial direction, or aerosol draw direction, of the aerosol permeation element. Similarly, multidirectional or random or multidirectional and random oriented fibres refers to a plurality of fibres which are predominantly misaligned, having a plurality of different or random or different and random orientations, including both parallel and perpendicular with respect to the axial or aerosol draw direction.

The core may comprise a resistance to draw of between 0.3 millimetres, water gauge (mmWG) to 5 millimetres, water gauge (mmWG), preferably between 0.5 millimetres, water gauge (mmWG) and 2 millimetres, water gauge (mmWG), per millimetre of length, for example, axial length, of the aerosol permeation element. Millimetre, water gauge (mmWG) is also known as millimetre of water (mmH2O).

The core may comprise one or more sensorial additives, such as ingredients, flavours, or other chemicals, for example, for modifying or enhancing the sensorial experience of the consumer. The one or more sensorial additives may comprise porous media, granules, botanicals, capsules, a coating or any other elements or materials.

The sleeve may comprise two or more longitudinal segments, which may be bonded, secured, connected or joined together, for example along longitudinal edges of the segments, for example, at least the longitudinal edges. The segments may form an integral sleeve, for example the tow material of the longitudinal segments may be bonded or joined together.

At least two or all of the segments may be formed from the same tow. Additionally or alternatively, the core may comprise fibres formed form the same tow as at least one of the segments. In embodiments, the core comprises fibres formed from the same tow as the two or more segments, for example the same tow as all of the segments.

The sleeve, or the tow from which the sleeve is formed, may comprise cellulose acetate or poly lactic acid fibres. The core, or the tow from which the core is formed, may comprise cellulose acetate or poly lactic acid fibres. The sleeve or core or the tow from which the sleeve or core (or both sleeve and core) is formed may comprise polypropylene, poly(3-hydroxybutyrate-co-hydroxyvalerate) (PHVB), rayon, viscose or regenerated cellulose fibres. The tow from which the sleeve or core or sleeve and core is formed may comprise a denier per filament (dpf) of between 3.0 dpf to 15.0 dpf and preferably between 5.0 dpf to 10.0 dpf. The tow from which the sleeve or core (or both sleeve and core) is formed may comprise a Y-shaped cross-section.

The segments or the tow from which the segments are formed may, but need not, comprise a plasticiser. Alternatively, the longitudinal segments may be secured, connected or joined together by an adhesive, such as a polyvinyl alcohol or polyvinyl acetate. Preferably, the core is substantially free of any plasticiser or adhesive. The core or at least some of the fibres thereof may be secured, connected or joined to the sleeve by the plasticiser or adhesive.

The sleeve may comprise a thickness, for example a wall thickness, of between 0.5 millimetres and 3 millimetres, for example between 0.5 millimetres and 1.5 millimetres or between 1 millimetre and 2 millimetres. The core may be between 2 millimetres and 8 millimetres, for example the core may comprise a diameter of between 2 millimetres and 8 millimetres. The core may be between 4 millimetres and 6 millimetres, for example the core may comprise a diameter of between 4 millimetres and 6 millimetres. The aerosol permeation element may be between 3 millimetres and 9 millimetres, for example the aerosol permeation element may comprise a diameter of between 3 millimetres and 9 millimetres. The aerosol permeation element may be between 5 millimetres and 7 millimetres, for example the aerosol permeation element may comprise a diameter of between 3 millimetres and 9 millimetres.

Another aspect of the invention provides an aerosol generating article comprising an aerosol permeation element as described above. The aerosol permeation element may be wrapped in a wrapper such as paper.

The aerosol generating article may comprise an aerosol generating or sensorial material, for example tobacco. The aerosol generating article may comprise a rod of aerosol generating or sensorial material, which may be connected, secured or attached to the aerosol permeation element. In embodiments, the aerosol generating article comprises a further sleeve within which the aerosol generating or sensorial material is received. The further sleeve may be connected, secured or attached to the aerosol permeation element, for example by tipping paper.

Another aspect of the invention provides a method of manufacturing an aerosol permeation element for use in an aerosol generating article, the method comprising: forming two or more strips into segments surrounding a conveying path; bringing the segments together into a sleeve former to form a sleeve; and introducing loose fibres between the segments upstream of the sleeve former such that they are drawn therein in a multidirectional or random orientation (or multidirectional and random orientation) and compressed between the segments as they are brought together to form an aerosol permeable core within the sleeve.

The introduction of loose fibres may comprise generating a turbulent flow of the fibres, preferably toward the inlet. The turbulent flow may be generated using a flow inducing means, such as one or more fans, blowers or air jets. The fans, blowers or air jets may be oriented in different directions, preferably toward the inlet.

The method may comprise separating a tow into the two or more strips, for example by passing the tow through or between one or more, for example, a pair or set of, slitting rollers. Additionally or alternatively, the method may comprise passing the strips over a guide, for example toward each other or into the sleeve former (or towards each other and into the sleeve former), which may be downstream of the guide. The method may comprise passing the strips over the guide and into the sleeve former such that the segments are substantially or at least partially tubular or part-conical (or partially tubular and part-conical) between the guide and the sleeve former. The method may comprise drawing the segments together, for example into the sleeve former. The method may comprise causing the segments to be bonded, secured, connected or joined together. The method may comprise causing the tow material of the segments to bond together, such as by applying heat or pressure (or heat and pressure), for example within the sleeve former, to form an integral sleeve.

The method may comprise fragmenting a further strip, which may be formed from a tow. The further strip may be fragmented, for example, using a fibre or loose fibre generation means or generator, to produce the loose fibres, for example prior to their introduction between the segments. Fragmenting the further strip may comprise passing the further strip through or between one or more, for example, a pair or set of, crimping rollers. The crimping rollers may stretch or slit the further strip into the loose fibres, or both stretch and slit the further strip into loose fibres.

The method may comprise separating a tow, for example, using a tow separating means or separator, into at least three strips, which may comprise or include the two or more strips or the further strip (or the two or more strips and the further strip). For example, the method may comprise passing the tow through or between the slitting roller(s) to separate the tow into the at least three strips. Two or more of the strips, for example the outermost strips, formed from the tow may be passed over the guide or into the sleeve former (or both over the guide and into the sleeve former). One or more of the strips, for example one or more inner or central strips, formed by the tow may be passed through or between the crimping roller(s). In specific embodiments, the method may comprise an initial step of providing a single tow band, which is slit into three strips, for example first and second strips directed to form an outer sleeve with oriented fibres (for example, having same orientation as the initial band), or a third strip is directed to form the randomly oriented fiber core; or the first and second strips are directed to form an outer sleeve with orientated fibres and the third strip is directed to form the randomly orientated fiber core.

The method may comprise separating or cutting the formed sleeve and core into a plurality of aerosol permeation elements, for example using an aerosol permeation element separation means or separator, such as a cutting station.

In combination with other features, in specific embodiments of the invention there is provided a method of manufacturing an aerosol generating article comprising manufacturing an aerosol permeation element as described above and combining the aerosol permeation element with a rod containing sensory media, such as tobacco.

According to the invention there is provided an aerosol permeation element manufactured as described herein.

According to the invention there is provided an aerosol permeation element for use in an aerosol generating article;

wherein the sleeve or the core, or both the sleeve and core, of the aerosol permeation element comprises cellulose acetate or poly lactic acid fibres; and is manufactured by the method as described herein.

According to the invention there is provided an aerosol permeation element for use in an aerosol generating article; wherein the sleeve comprises a wall thickness of between 0.5 millimetres and 3 millimetres; and is manufactured by the method as described herein.

According to the invention there is provided an aerosol permeation element for use in an aerosol generating article; wherein the core comprises a diameter of between 2 millimetres and 8 millimetres; and is manufactured by the method as described herein.

Another aspect of the invention provides an apparatus for manufacturing an aerosol permeation element of an aerosol generating article, the apparatus comprising: a guide means or guide for forming strips from a tow into segments surrounding a conveying path; a delivery means or device for introducing an aerosol permeable core material between segments formed by the guide means or guide; and a sleeve forming means or former downstream of the guide means or guide for receiving segments formed by the guide means or guide and aerosol permeable core material introduced therebetween by the delivery means or device, wherein the sleeve forming means or former is configured to bring the segments together to form a sleeve surrounding an aerosol permeable core formed from the core material.

The delivery means or device may comprise a fibre or loose fibre generation means or generator. The delivery or fibre generation means may comprise one or more, for example, a pair or set of, crimping rollers. The delivery or fibre generation means may be for, for example, suitable for, fragmenting a further strip formed from a tow, for example to produce loose fibres. The delivery means or device may comprise a flow inducing means or inducer, for example for generating a turbulent flow of the core material, for example fibres thereof, before they are introduced between segments formed by the guide. The flow inducing means may comprise one or more fans, blowers or air jets, which may be oriented in different directions, preferably toward the inlet.

The sleeve forming means or former may comprise a forming funnel, which may be for receiving, or shaping, for example, in concave or convex shape, (or both receiving and shaping) and compressing the segments formed by the guide or the core material received by the delivery device, or both the segments formed by the guide and the core material received by the delivery device. The sleeve forming means or former may comprise a tubular element, for example downstream of the forming funnel, for example, for maintaining the formed aerosol permeation element(s) in a compressed state. The apparatus or sleeve forming means may comprise a drawing means, mechanism or device for drawing a length or rod of finished, for example, integral, aerosol permeation elements. The drawing means or mechanism may comprise a pulling device, which may comprise a motor and a conveying means or conveyor for pulling or drawing the length or rod of finished, for example, integral, aerosol permeation elements through and out of the sleeve forming means or former. The conveying means may comprise one or more, such as a set or pair of, pulling rollers.

The apparatus may comprise a wrapping unit, to wrap a rod with a wrapper, such as a paper.

The apparatus may comprise a tow separating means or separator, for example, for separating a tow into two or more strips. The tow separating means may comprise one or more, for example, a pair or set of, slitting rollers.

The apparatus may comprise an aerosol permeation element separation means or separator. The apparatus or separation means may comprise a cutting means or station, for example, for cutting the formed sleeve and core into a plurality of aerosol permeation elements. The cutting means or station may be downstream of the sleeve forming means or drawing means (or downstream of both the sleeve forming means and the drawing means). The cutting means may be for separating, cutting or severing a sleeve or core (or both sleeve and core) exiting the sleeve forming means to form a series of aerosol permeation elements.

For the avoidance of doubt, any of the features described herein apply equally to any aspect of the invention. For example, the aerosol generating article may comprise any one or more features of the aerosol permeation element or vice versa likewise the method may comprise any one or more features or steps relevant to one or more features of the aerosol permeation element or the aerosol generating article.

In combination with other features, specific embodiments may further comprise a computer program element comprising computer readable program code means for causing a processor to execute a procedure to implement one or more steps of the aforementioned method.

In combination with other features, specific embodiments may further comprise a computer program element embodied on a computer readable medium.

In combination with other features, specific embodiments may further comprise a computer readable medium having a program stored thereon, where the program is arranged to make a computer execute a procedure to implement one or more steps of the aforementioned method.

In combination with other features, specific embodiments may further comprise a control means or control system or controller comprising the aforementioned computer program element or computer readable medium.

All scientific and technical terms used herein have meanings commonly used in the art unless otherwise specified. The definitions provided herein are to facilitate understanding of certain terms used frequently herein.

As used herein, the term "aerosol generating article" refers to an article comprising an aerosol forming substrate that is capable of releasing volatile compounds that can form an aerosol, for example by heating, combustion or chemical reaction.

As used herein, the term "aerosol forming substrate" is used to describe a substrate capable of releasing volatile compounds, which can form an aerosol. The aerosols generated from the aerosol forming substrates of aerosol generating articles according to the invention may be visible or invisible and may include vapours (for example, fine particles of substances, which are in the gaseous state, that are ordinarily liquid or solid at room temperature) as well as gases and liquid droplets of condensed vapours.

As used herein, the term "sheet" denotes a laminar element having a width and length greater than the thickness thereof.

As used herein, the term "aerosol permeation element" is used to describe an element that allows permeation of an aerosol through it, partially or fully. Typically, the aerosol permeation element will be, but not limited to, a filter, a spacer or a cooling element. The aerosol permeation element may have a combination of functions.

As used herein, the term "sleeve" is used to describe a partial or full cover. Ideally partially covering the longitudinal outer surface of the core of the aerosol permeation element. The term "core", as used herein, is used to describe the inner portion of the aerosol permeation element at least partially covered by the sleeve of the aerosol permeation element.

The terms "upstream" and "downstream" refer to relative positions of elements of the aerosol generating article described in relation to the direction of inhalation air flow as it is drawn through the body of the aerosol generating article from a distal, tip end to the mouthpiece end. In other words as used herein, "downstream" is defined relative to air flow during use of the smoking article or aerosol generating article, with the mouthpiece end of the article being the downstream end through which air and aerosol is drawn. The end opposite the mouthpiece end is the upstream end.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Within the scope of this application it is expressly intended that the various aspects, embodiments, examples and alternatives set out in the preceding paragraphs, in the claims, in the description and drawings, and in particular the individual features thereof, may be taken independently or in any combination. That is, all embodiments or features of any embodiment can be combined in any way, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from or incorporate any feature of any other claim although not originally claimed in that manner, or to incorporate features described in the description.

Embodiments of the invention will now be described by way of example only with reference to the accompanying drawings in which.

Figure 1:
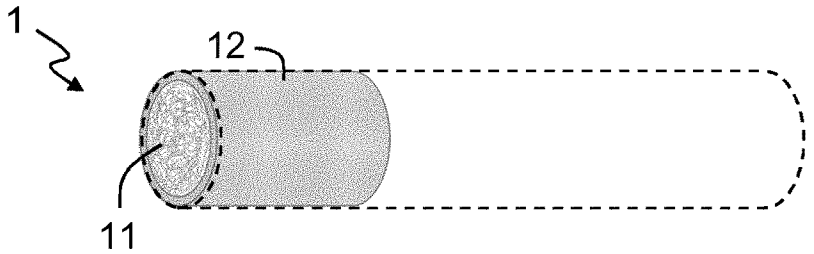
FIG. 1 is a perspective view of an aerosol permeation element according to an embodiment of the invention.
Figure 2:
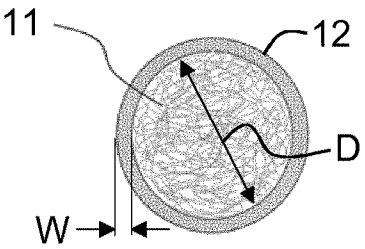
FIG. 2 is a cross-sectional view of the aerosol permeation element of FIG. 1.

Referring now to FIGS. 1 and 2, there is shown an aerosol permeation element 1 according to an embodiment of the invention, which is a filter part 1 (which can act as a cooling part) for an aerosol generating article (shown in outline). The filter part 1 in this embodiment includes an aerosol permeable core 11 of expanded, randomly oriented fibres. The core 11 is surrounded by a sleeve 12 of linear, axially oriented fibres. In this embodiment, the sleeve 12 has a wall thickness W of 1 millimetre and the aerosol permeable core 11 has a diameter D of 5 millimetres. The core 11 may be configured to provide a resistance to draw of between 0.5 millimetres, water gauge (mmWG) and 2 millimetres, water gauge (mmWG) per millimetre of axial length of the filter part 1, depending on the materials used and the processing parameters used during the manufacture thereof.

Figure 3:
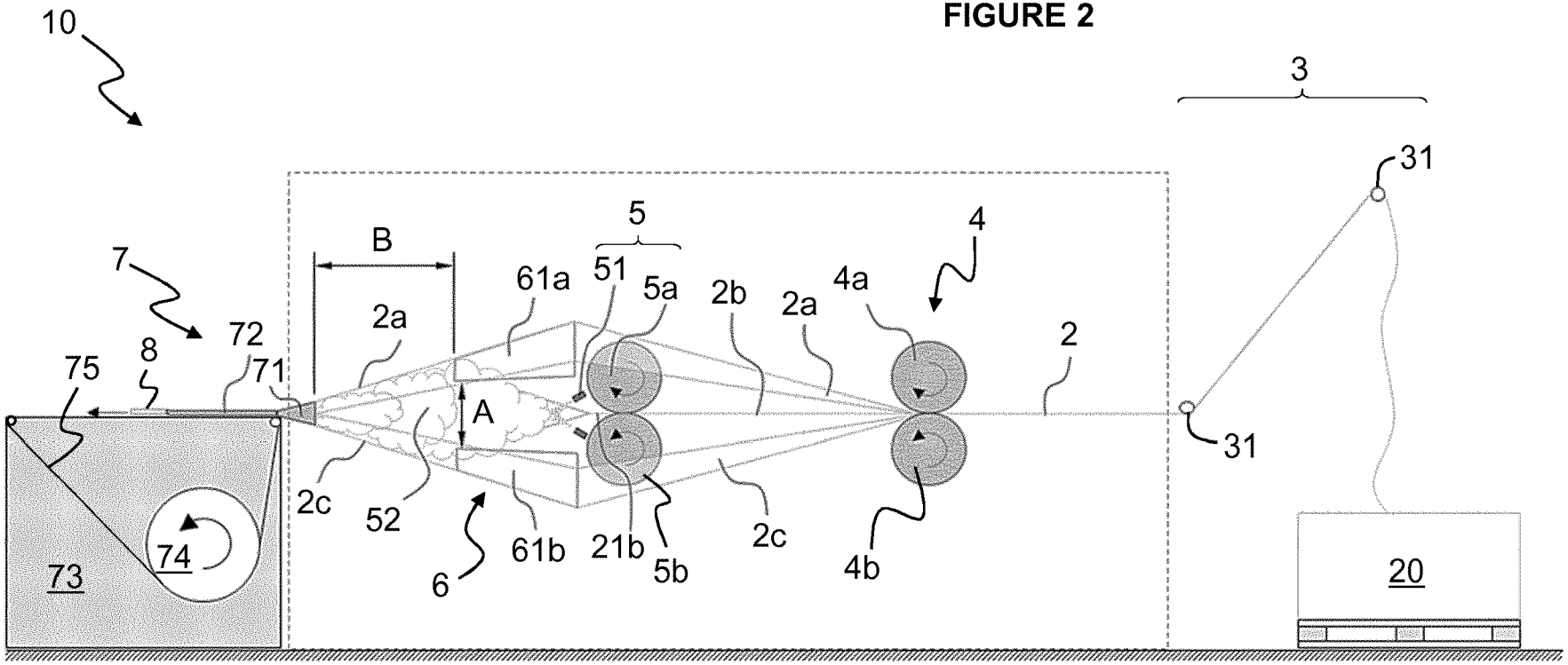
FIG. 3 is a schematic of a filter manufacturing apparatus according to an embodiment of the invention.
Figure 4:
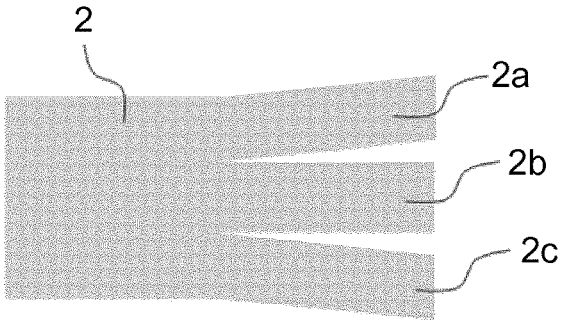
FIG. 4 is a schematic of a tow as it is formed into three strips by the apparatus of FIG. 3.
Figure 5:
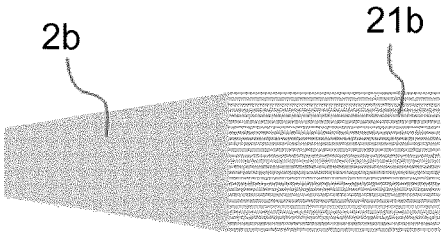
FIG. 5 is a schematic of the central strip as it is stretched and slit by the apparatus of FIG. 3.

FIGS. 3 to 6 show an apparatus 10 for manufacturing the filter part 1 of FIGS. 1 and 2. As illustrated in FIG. 3, a length of tow 2 is fed from a storage container 20 via a feed assembly 3 and through a separator 4, which separates the tow 2 into three strips 2*a*, 2*b*, 2*c*. A central strip 2*b* is fed into a fragmentation delivery device 5, while outer strips 2*a*, 2*c* are fed to a guide 6 that partially surrounds a conveying path along which the central strip 2*b* is conveyed. The delivery device 5 fragments the central strip 2*b* into a plurality of fibres 52 and introduces them between the outer strips 2*a*, 2*c* as they pass over the guide 6. The outer strips 2*a*, 2*c* and fibres 52 introduced between them are received within a sleeve former 7, which brings the strips 2*a*, 2*c* and fibres 52 together, compresses them and joins the outer strips 2*a*, 2*c* about the fibres 52 to form the filter rod 8.

In this embodiment, the tow 2 is formed of poly lactic acid (PLA) fibres aligned longitudinally along its length. The tow feed assembly 3 has a pair of tensioning rollers 31 for creating tension in the tow 2 as it is conveyed into the tow separator 4 from the storage container 20. The tow separator 4 is located downstream of the tow feed assembly 3 and includes a pair of opposed, counter-rotating separation rollers 4*a*, 4*b* configured, in use, to rotate in the conveying direction of the apparatus 10 at a speed R1. Each of the separation rollers 4*a*, 4*b* has a pair of cutters or blades 41*a*, 41*b* (shown in FIG. 6), which cooperate with those of the other roller 4*b*, 4*a* to slit the tow 2 as it passes therebetween. As a result, the tow separator 4 splits the tow 2 from the tow feed assembly 3 into three strips, namely the outer strips 2*a*, 2*c* and the central strip 2*b*.

The delivery device 5 is downstream of the tow separator 4 and has a pair of opposed, counter-rotating crimping rollers 5*a*, 5*b* arranged to rotate in the conveying direction of the apparatus 10. In this embodiment, the crimping rollers 5*a*, 5*b* rotate at a speed R2, which is selected to create a greater interface speed than that of the tow separator 4, thereby stretching the central strip 2*b* as it passes between them. Each of the crimping rollers 5*a*, 5*b* has a plurality of grooves (not shown) on its surface, which provide a crimping effect as the central strip 2*b* passes therethrough, and cutting elements or blades (not shown), which cut the central strip 2*b* as it passes between them. The stretching caused by the speed R2 of the crimping rollers 5*a*, 5*b*, together with the grooves and cutting elements or blades (not shown), slit and stretch the central strip 2*b* of the tow 2 as it passes therethrough.

The delivery device 5 also has a flow inducer in the form of air jets 51 downstream of the crimping rollers 5*a*, 5*b*, which are distributed around the exit of the crimping rollers 5*a*, 5*b* and are directed downstream and toward the conveying path. As such, each jet 51 induces a flow downstream and toward the conveying path, which impinges the flow from the other jet(s) 51 to generate a turbulent flow of fibres 52 as they exit the crimping rollers 5*a*, 5*b*.

Figure 6:
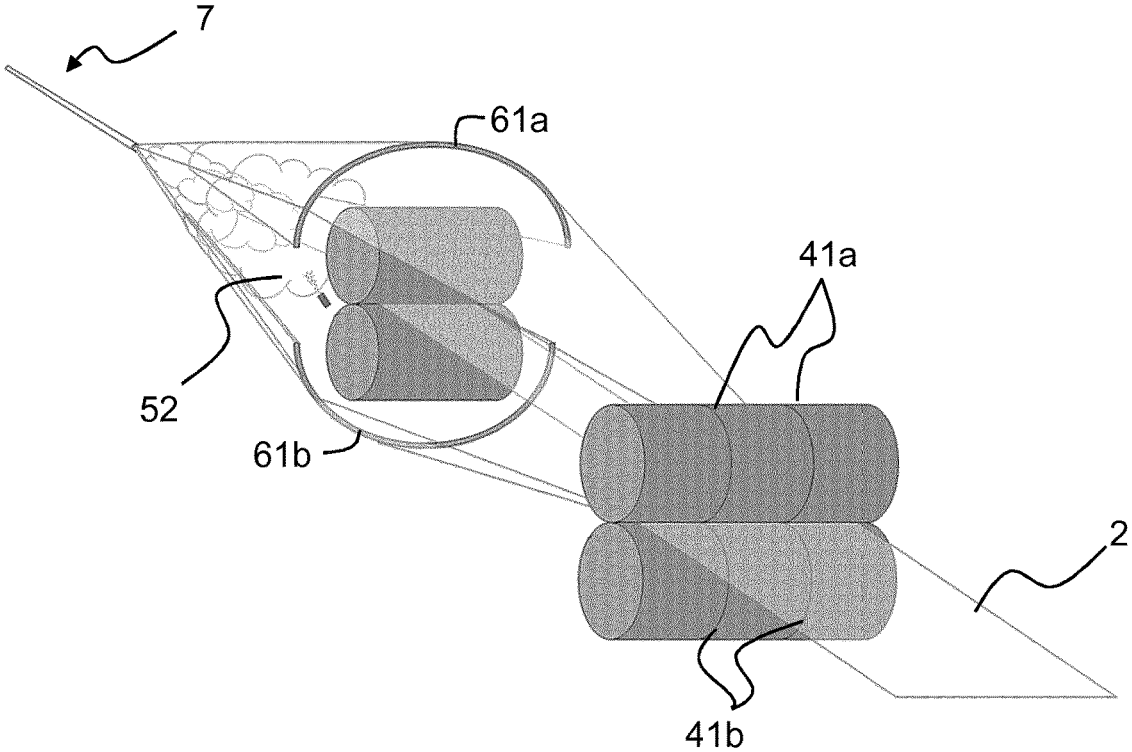
FIG. 6 is a perspective view of part of the filter manufacturing apparatus of FIG. 3.

The guide 6 is also downstream of the tow separator 4 and includes a pair of opposed, spaced part-conical and tubular guide members 61*a*, 61*b* (shown more clearly in FIG. 6). An upper guide member 61*a* lies above the conveying path and a lower guide member 61*b* lies below the conveying path. Together, the guide members 61*a*, 61*b* partially surround the conveying path, with a vertical gap A between them. Each of the guide members 61*a*, 61*b* tapers inwardly toward the sleeve former 7. The downstream ends of the guide members 61*a*, 61*b* are spaced from the sleeve former 7 by a distance B. In this embodiment, the jets 51 are adjacent the upstream end of the guide members 61*a*, 61*b*, such that the turbulent flow of fibres 52 is directed into the space between the guide members 61*a*, 61*b* and toward the sleeve former 7.

The sleeve former 7 has a first, conical segment or forming funnel 71 and a second, tubular element 72 downstream of the conical segment 71. The conical segment 71 tapers inwardly along a conveying direction to the diameter of the tubular element 72. The sleeve former 7 is heated in this embodiment, such that the outer strips 2*a*, 2*c* of tow 2 are bonded together by both heat and compression as they are conveyed, together with the fibres 52 from the central strip 2*b* of the tow 2, through the sleeve former 7. The sleeve former 7 also includes a drawing mechanism 73 for drawing a length of completed filter rod 8 through and out of the tubular element 72 of the sleeve former 7. The drawing mechanism 73 includes a motor 74 and a conveying belt 75 for pulling or drawing the filter rod 8. The apparatus 1 may also include an integral cutting station (not shown) downstream of the sleeve former 7 to cut the rod into filter parts 1. Alternatively, the filter rod 8 may be fed into another apparatus for further processing.

In use, a length of tow 2 is fed from the storage container 20 via the tensioning rollers 31 of the tow feed assembly 3 and into the tow separator 4. The tow 2 passes between the rollers 4*a*, 4*b* of the tow separator 4, where the cutters 41*a*, 41*b* split the tow 2 into the outer and central strips 2*a*, 2*b*, 2*c*. The outer strips 2*a*, 2*c* are separated from the conveying path, with a first outer strip 2*a* passing over the upper guide member 61*a* and a second outer strip 2*c* passing over the lower guide member 61*b*. The outer strips 2*a*, 2*c* expand and conform to the profile of the respective guide member 61*a*, 61*b* as they are passed thereover. The guide members 61*a*, 61*b* create tension in the outer strips 2*a*, 2*c* and guide them toward the sleeve former 7. The guide members 61*a*, 61*b* deform and stretch the outer strips 2*a*, 2*c* into part-conical, tubular segments that partially surround the conveying path of the apparatus 10.

The central strip 2*b* is fed from the tow separator 4 into the delivery device 5 and passes between the crimping rollers 5*a*, 5*b*, which stretch, slit and fragment the central strip 2*b* to form a modified tow region 21*b* of loose fibres 52. Once the central strip 2*b* has passed through the crimping rollers 5*a*, 5*b* the modified tow region 21*b* is acted upon by the air jets 51, which generate the turbulent flow of fibres 52. The air jets 51 act on the fibres 52 such that they are directed downstream and toward the conveying path and into the space between the guide members 61*a*, 61*b*.

The fibres 52 are drawn into the sleeve former 7 in a random orientation along with the part-conical, tubular outer strips 2*a*, 2*c*. The outer strips 2*a*, 2*c* are suspended between the downstream end of the guide members 61*a*, 61*b* and the sleeve former 7 such that they are exposed to the fibres 52. The outer strips 2*a*, 2*c* may have a plasticizer applied thereto as they pass over the guide members 61*a*, 61*b*, for example from a plasticizer spraying apparatus (not shown). The application of a plasticizer not only facilitates the bonding of the outer strips 2*a*, 2*c*, but it also causes the fibres 52 to adhere to the outer strips 2*a*, 2*c* as they come into contact with them.

The outer strips 2*a*, 2*c* are brought together as they are drawn into the conical segment 71 of the sleeve former 7. The fibres 52 are compressed gradually between the outer strips 2*a*, 2*c* as they are conveyed from the conical segment 71 toward the tubular element 72. The longitudinal edge regions of the outer strips 2*a*, 2*c* overlap as they enter the sleeve former 7. As such, the overlapping regions are bonded together, using heat and compression, as the outer strips 2*a*, 2*c* pass through the sleeve former 7 such that they describe a sleeve surrounding the fibres 52 to form a length of filter rod 8. The drawing mechanism 73 draws the filter rod 8 through and out of end of the tubular element 72 for processing or cutting into a plurality of filter parts 1 (or both processing and cutting into a plurality of filter parts).

The central and outer strips 2*a*, 2*b*, 2*c* are formed from the same tow 2. As such, the core 11 and sleeve 12 of an aerosol permeation element 1 made using this apparatus 10 are formed from the same material. In some embodiments, however, one or more of the strips 2*a*, 2*b*, 2*c* may undergo further intermediate processing, for example chemical processing, to alter its properties. Additionally or alternatively, the fibres 52 may undergo further processing, for example chemical processing, prior to being introduced, or as they are introduced, into the sleeve former 7.

It will be appreciated by those skilled in the art that the parameters of the filter part 1 may be altered by changing one or more processing parameters. For example, the quantity or density of fibres 52 may be increased or decreased by changing the width of the central strip 2*b* wider, for example by changing the space between the cutters 41*a*, 41*b* of the separation rollers 4*a*, 4*b*. The thickness of the sleeve 12 may be increased or decreased in a similar manner. Additionally or alternatively, the thickness of the sleeve 12 may be changed by modifying the extent to which the outer strips 2*a*, 2*c* are stretched, for example by changing the difference between the speed R1 of the separation rollers 4*a*, 4*b* and the rate at which the drawing mechanism 73 draws the finished rod 8. Similarly, each of the central and outer strips 2*a*, 2*b*, 2*c* may be treated at various stages of the process to alter their characteristics.

As such, the invention provides a versatile means of producing aerosol permeation elements 1 whose characteristics can be varied across a wide range.

Referring now to FIGS. 5 to 8, there is shown an apparatus 100 according to another embodiment of the invention for manufacturing filter parts 1 having a core 11 formed of a different material to the sleeve 12. The apparatus 100 according to this embodiment is similar to the apparatus 10 of the first embodiment, wherein like features are denoted by like references, which will not be described further. The apparatus 100 differs from that of the first embodiment in that the central strip 2*b* is provided by a different tow 102 to the tow 2 from which the outer strips 2*a*, 2*c* are formed. The different tow 102 may be formed of a different material or have one or more different characteristics (or both be formed of a different material and have one or more different characteristics) to the tow 2 from which the outer strips 2*a*, 2*c* are formed.

The apparatus 100 includes a tow separator 104 having a pair of opposed, counter-rotating separation rollers 141, 142 each having a single, opposed cutter or blade 143, 144. The separation rollers 141, 142 operate in substantially the same manner as those of the first embodiment, except that the cutters 143, 144 cooperate to split the tow 2 only into the outer strips 2*a*, 2*c* in this embodiment. The apparatus 100 has a further tow storage container 120 of the different tow 102 and a further tow feed assembly 103. The further tow feed assembly 103 has a further pair of tensioning rollers 131 for creating tension in the tow 102 as it is conveyed into the apparatus 100. The further tow feed assembly 103 also includes alignment rollers 132, 133 for aligning the tow 102 prior to entry into the delivery device 5.

Figure 7:
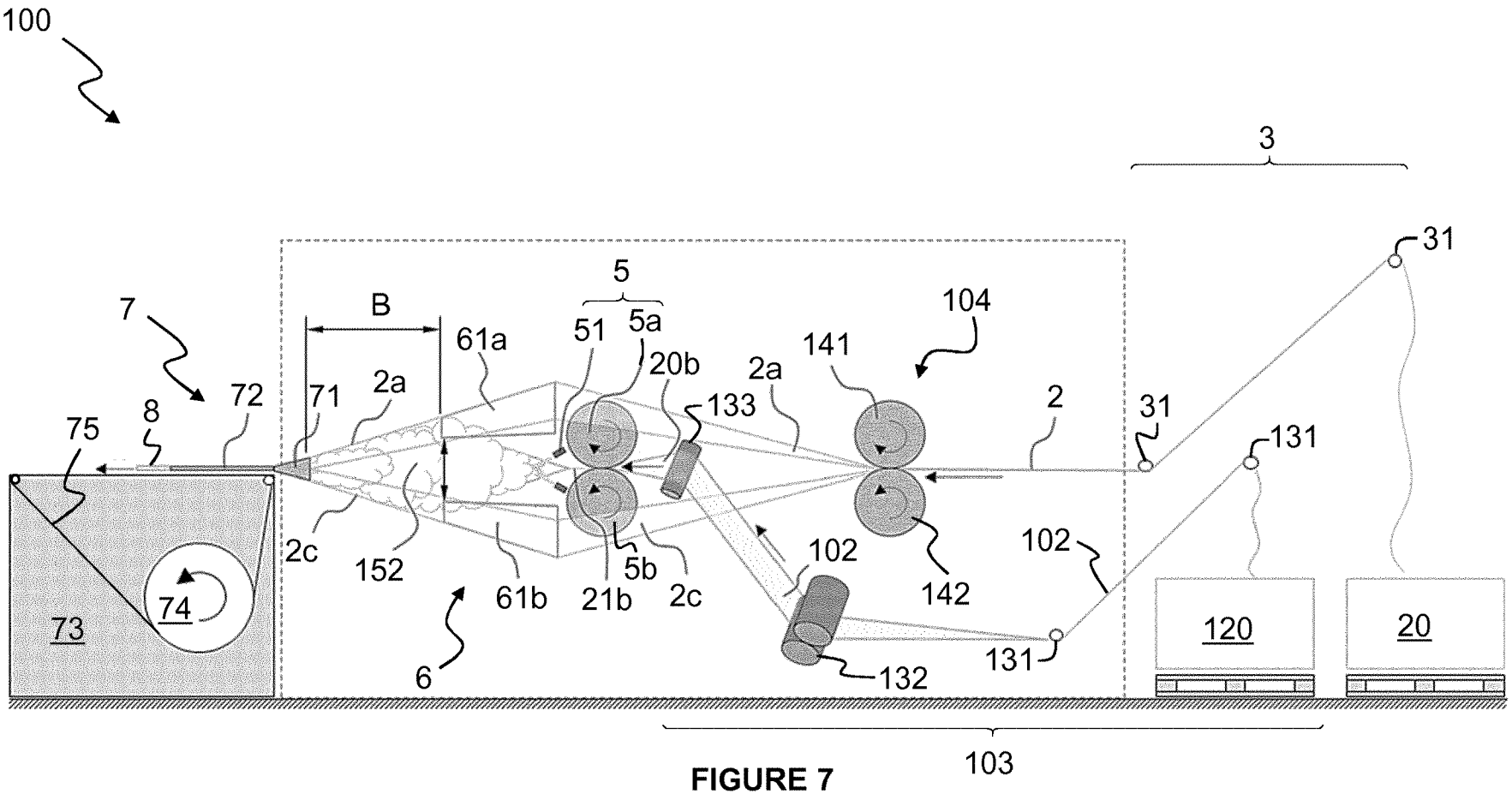
FIG. 7 is a schematic of a filter manufacturing apparatus according to another embodiment of the invention.
Figure 8:
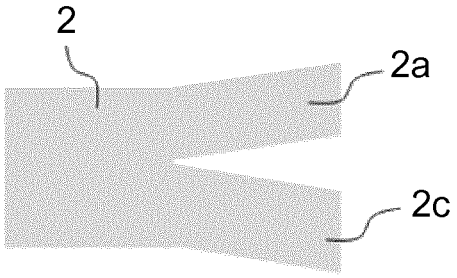
FIG. 8 is a schematic of a tow as it is formed into two strips by the apparatus of FIG. 7.
Figure 9:
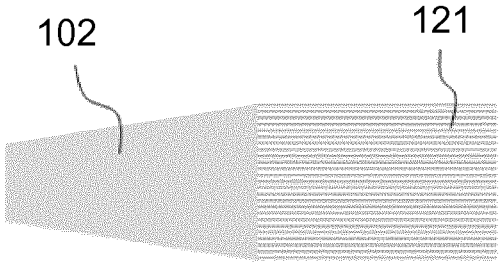
FIG. 9 is a schematic of a further strip as it is stretched and slit by the apparatus of FIG. 7.
Figure 10:
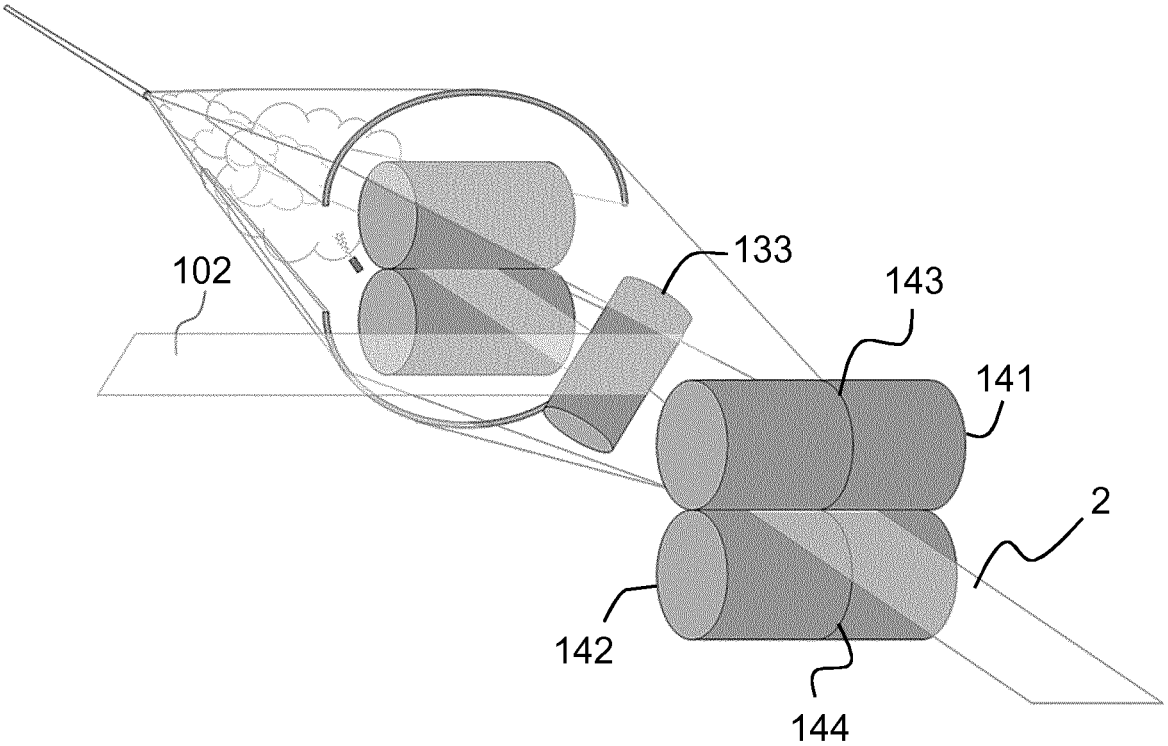
FIG. 10 is a perspective view of part of the filter manufacturing apparatus of FIG. 7.

More specifically, a first pair of alignment rollers 132 is external of the conveying path, while a second alignment roller 133 is within the conveying path, immediately upstream of the crimping rollers 5*a*, 5*b*. The tow 102 is fed from the storage container 120 to the delivery device 5 via the alignment rollers 132, 133 such that it passes between the outer strips 2*a*, 2*c* downstream of the tow separator 104 and into the conveying path between the tow separator 104 and the guide 6. As illustrated in FIGS. 7 and 10, the axes of rotation of the alignment rollers 132, 133 lie at an angle relative to the separation rollers 141, 142 and crimping rollers 5*a*, 5*b* to enable transverse feeding of the tow 102 through the vertical gap between the outer strips 2*a*, 2*b*. In this embodiment, the tensioning rollers 131, alignment rollers 132, 133 and strip feed roller 133 are non-driven.

In use, the tow 2 is fed into the tow separator 104 via the tow feed assembly 3 and is split into outer strips 2*a*, 2*c* by the separation rollers 141, 142. The outer strips 2*a*, 2*c* are conveyed through the apparatus 100 in a similar way to the apparatus 10. The further length of tow 102 is fed from the storage container 120 via the further tow feed assembly 103 into the delivery device 5. The further length of tow 102 provides the central strip in this embodiment. The further tow 102 is fed into the delivery device 5 and passes between the pair of crimping rollers as per apparatus 10, where a modified tow region 121 of loose fibres 152 is created. The modified tow region 121 is fragmented and a turbulent flow of fibres 152 created, as per apparatus 10.

It will be appreciated by those skilled in the art that several variations to the aforementioned embodiments are envisaged without departing from the scope of the invention. For example, the number of strips 2*a*, 2*c* used to form the sleeve 12 may be more than two in number. The strip or strips 2*a*, 2*c* used to form the sleeve may undergo further intermediate processing, for example chemical processing, to alter their properties. Moreover, while the outer strips 2*a*, 2*c* are described as being bonded together using heat and pressure, this need not be the case. They may be secured together using an adhesive. Similarly, the outer strips 2*a*, 2*c* may, but need not, include a plasticizer applied thereto. Moreover, while the flow inducer 51 described as being a pair of opposed air jets this need not be the case. The flow inducer 51 may be one or more fans or blowers or any combination thereof or any other suitable flow inducing means. Other variations are also envisaged and would be appreciated by those skilled in the art.

It will also be appreciated by those skilled in the art that any number of combinations of the aforementioned features and those features shown in the appended drawings provide clear advantages over the prior art and are therefore within the scope of the invention described herein.

The invention claimed is:

1. An aerosol permeation element for use in an aerosol generating article, the aerosol permeation element comprising an aerosol permeable core surrounded by a sleeve, wherein the sleeve comprises linear, axially oriented fibres and the core comprises expanded, randomly oriented fibres, wherein the sleeve comprises two or more longitudinal segments formed from the same tow and the tow material of the longitudinal segments is bonded together at least along longitudinal edges of the segments to form an integral sleeve.

2. Aerosol permeation element according to claim 1, wherein the core comprises fibres formed from the same tow as the two or more longitudinal segments.

3. Aerosol permeation element according to claim 1, wherein the tow, from which the sleeve or core or both the sleeve and core, is formed, comprises cellulose acetate or poly lactic acid fibres.

4. Aerosol permeation element according to claim 1, wherein the sleeve comprises a wall thickness of between 0.5 millimetres and 3 millimetres.

5. Aerosol permeation element according to claim 1, wherein the core comprises a diameter of between 2 millimetres and 8 millimetres.

6. An aerosol generating article comprising an aerosol permeation element according to claim 1.

7. A method of manufacturing an aerosol permeation element for use in an aerosol generating article, the method comprising:

forming two or more strips into segments surrounding a conveying path;

bringing the segments together into a sleeve former to form a sleeve comprised of linear, axially oriented fibers; and introducing loose fibres between the segments upstream of the sleeve former such that they are drawn therein in a random orientation and compressed between the segments as they are brought together to form an aerosol permeable core within the sleeve.

8. Method according to claim 7, wherein the introduction of loose fibres comprises generating a turbulent flow of the fibres using a plurality of air jets oriented in different directions toward the inlet.

9. Method according to claim 7 comprising separating a tow into the two or more strips.

10. Method according to claim 7 comprising passing the strips over a guide, toward each other and into the sleeve former downstream of the guide such that the segments are substantially part-conical between the guide and the sleeve former, drawing the segments together into the sleeve former and causing the tow material of the segments to bond together by applying a plasticizer, or heat, or pressure, or any combination thereof, within the sleeve former to form an integral sleeve.

11. Method according to claim 7 comprising fragmenting a further strip formed from a tow to produce the loose fibres prior to their introduction between the segments.

12. Method according to claim 11, wherein fragmenting the further strip comprises passing the further strip between a set of crimping rollers which stretch and slit the further strip into the loose fibres.

13. Method according to claim 11 comprising separating a tow into at least three strips comprising the two or more strips and the further strip.

14. A method of manufacturing an aerosol generating article comprising manufacturing an aerosol permeation element using a method according to claim 7 and combining the aerosol permeation element with a tobacco containing rod.

15. An aerosol permeation element for use in an aerosol generating article, manufactured by the method of claim 7.

16. An aerosol permeation element for use in an aerosol generating article; wherein the sleeve or the core, or both the sleeve and core, of the aerosol permeation element comprises cellulose acetate or poly lactic acid fibres; and is manufactured by the method of claim 7.

17. An aerosol permeation element for use in an aerosol generating article; wherein the sleeve comprises a wall thickness of between 0.5 millimetres and 3 millimetres; and is manufactured by the method of claim 7.

18. An aerosol permeation element for use in an aerosol generating article; wherein the core comprises a diameter of between 2 millimetres and 8 millimetres; and is manufactured by claim 7.

* * * * *